US011346024B2

(12) United States Patent
Arichi et al.

(10) Patent No.: US 11,346,024 B2
(45) Date of Patent: May 31, 2022

(54) BASE FABRIC, JET LOOM, AND METHOD OF MANUFACTURING BASE FABRIC

(71) Applicant: Toray Industries, Inc., Tokyo (JP)

(72) Inventors: Tamotsu Arichi, Otsu (JP); Hironori Shinkai, Otsu (JP); Yoshihiro Kawahara, Otsu (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 16/960,675

(22) PCT Filed: Dec. 10, 2018

(86) PCT No.: PCT/JP2018/045366
§ 371 (c)(1),
(2) Date: Jul. 8, 2020

(87) PCT Pub. No.: WO2019/146286
PCT Pub. Date: Aug. 1, 2019

(65) Prior Publication Data

US 2020/0354864 A1 Nov. 12, 2020

(30) Foreign Application Priority Data

Jan. 26, 2018 (JP) ..... JP2018-011415

(51) Int. Cl.
*D03D 47/36* (2006.01)
*D03D 47/32* (2006.01)
(Continued)

(52) U.S. Cl.
CPC ..... *D03D 47/36* (2013.01); *D03D 47/32* (2013.01); *D03D 1/02* (2013.01); *D03D 51/44* (2013.01);
(Continued)

(58) Field of Classification Search
CPC ..... D03D 47/36; D03D 47/32; D03D 1/02; D03D 51/44; D03D 47/30; D10B 2331/04; D10B 2505/124
See application file for complete search history.

(56) References Cited

U.S. PATENT DOCUMENTS 5,224,520 A 6/1993 Shinbara et al.
5,425,399 A 6/1995 Shindo et al.
(Continued)

FOREIGN PATENT DOCUMENTS

CN 106319713 A 1/2017
JP 02-269843 A 11/1990
(Continued)

OTHER PUBLICATIONS

The Extended European Search Report dated Sep. 14, 2021, of counterpart European Application No. 18901818.7.
(Continued)

*Primary Examiner* — Robert H Muromoto, Jr.
(74) *Attorney, Agent, or Firm* — DLA Piper LLP (US)

(57) ABSTRACT

A base fabric, having a coefficient of variation CV1 (100× standard deviation/average value) of 3.0% or less in a length direction of a weft-direction disintegrated yarn strength and a coefficient of variation CV2 (100×standard deviation/average value) of 4.0 or less in a length direction of a weft-direction disintegrated yarn elongation.

6 Claims, 2 Drawing Sheets

(51) Int. Cl.
*D03D 15/00* (2021.01)
*D03D 1/02* (2006.01)
*D03D 51/44* (2006.01)

(52) U.S. Cl.
CPC .... *D10B 2331/04* (2013.01); *D10B 2505/124* (2013.01)

(56) References Cited

U.S. PATENT DOCUMENTS 7,134,458 B2 * 11/2006 Horibe ..... D03D 47/345 139/452
7,560,061 B2 * 7/2009 Yu ..... D03D 1/02 264/289.6
8,962,499 B2 * 2/2015 Tanaka ..... D06N 3/0006 442/189
9,211,865 B2 * 12/2015 Furuniwa ..... D03D 1/02
9,797,071 B2 * 10/2017 Kim ..... D01D 5/16
9,951,176 B2 * 4/2018 Kim ..... D01D 5/098
10,562,483 B2 * 2/2020 Hosaka ..... D06M 15/643
2005/0142969 A1 * 6/2005 Yu ..... D03D 1/02 442/181
2006/0252322 A1 11/2006 DeBenedictis et al.
2011/0020628 A1 * 1/2011 Fukudome ..... C08G 69/28 428/221
2011/0316259 A1 * 12/2011 Ritter ..... D03D 1/02 280/728.1
2013/0147170 A1 * 6/2013 Tanaka ..... B60R 21/235 280/743.1
2013/0187367 A1 * 7/2013 Kim ..... D06N 3/0068 280/743.1
2013/0224468 A1 * 8/2013 Kim ..... D02G 3/446 428/221
2013/0267139 A1 * 10/2013 Kim ..... D01F 6/62 442/301
2015/0246655 A1 * 9/2015 Furuniwa ..... B60R 21/235 139/420 R
2017/0101731 A1 4/2017 Yamauchi et al.
2019/0071048 A1 3/2019 Akechi

FOREIGN PATENT DOCUMENTS

JP 04-97886 U 8/1992
JP 09-111578 A 4/1997
JP 11-507703 A 7/1999
JP 2003-147663 A 5/2003
JP 2004-316065 A 11/2004
JP 2017-075408 A 4/2017
WO 2017/159583 A1 9/2017

OTHER PUBLICATIONS

Examination Report under Sections 12 & 13 of the Patents Act, 1970, and the Patent Rules, 2003, dated Feb. 28, 2022, of counterpart Indian Patent Application No. 202047035530.

* cited by examiner

BASE FABRIC, JET LOOM, AND METHOD OF MANUFACTURING BASE FABRIC

TECHNICAL FIELD

This disclosure relates to a base fabric, a jet loom, and a method of manufacturing the base fabric. More specifically, the disclosure relates to a high-quality base fabric having small variations in strength and elongation, a jet loom capable of reducing the amount of fiber wastes generated when manufacturing such a base fabric, and a method of manufacturing the base fabric.

BACKGROUND

In recent years, when weaving with a jet loom, a weft yarn-drawing speed has been increasing for improving production efficiency. In general, a length measurement (length of a weft yarn to be beaten up) in a jet loom is performed by a length measuring device with a loom installed. On an upstream side where a weft yarn is run from a nozzle, the length measuring device catches the weft yarn by two rollers, i.e., a feed roller and a length measuring roller, and then forwards the weft yarn toward the nozzle.

A loom such as a jet loom integrally performs processes such as forwarding, opening, weft insertion, reed beating, and winding. Therefore, for weft insertion, vibrations and the like at the time of reed beating may propagate, and a weft yarn may not be sufficiently caught by the above-described two rollers. In view of this, a device that suppresses shaking (jumping) of the feed roller has been developed (JP 2017-075408 A).

However, the object of the device described in JP '408 is to simply diverge and suppress vibration by providing a wave washer or the like. The length measuring roller varies in size and may be worn by continued use. Therefore, in such a device, when length measuring rollers in various sizes are used, the pressure contact strength of the feed roller with respect to the length measuring roller cannot be kept constant, and shaking (jumping) of the feed roller cannot be sufficiently suppressed. Thus, the base fabric obtained tends to vary in strength and elongation in a weft direction and easily deteriorate in quality. Furthermore, since a weft yarn is beaten from the nozzle with the catching force being not constant, it is necessary to beat a weft yarn having a length that greatly exceeds the width of the desired base fabric to ensure the operation of the loom, leading to a tendency that excess weft yarns occur. Therefore, there is a problem that the amount of fiber wastes to be discarded increases.

It could therefore be helpful to provide a high-quality base fabric having small variations in strength and elongation, a jet loom capable of reducing the amount of fiber wastes generated when manufacturing such a base fabric, and a method of manufacturing the base fabric.

SUMMARY

We thus provide:

A base fabric has a coefficient of variation CV1 (100× standard deviation/average value) of 3.0% or less in a length direction of a weft-direction disintegrated yarn strength and a coefficient of variation CV2 (100×standard deviation/average value) of 4.0 or less in a length direction of a weft-direction disintegrated yarn elongation.

A base fabric includes a fabric part, and selvages having a predetermined width formed at both ends in a length direction of the fabric part, respectively, and has a coefficient of variation CV1' (100×standard deviation/average value) of 3.0% or less in a length direction of a weft-direction disintegrated yarn strength in a width direction including the selvages and a coefficient of variation CV2' (100×standard deviation average value) of 4.0 or less in a length direction of a weft-direction disintegrated yarn elongation in a width direction including the selvages.

A base fabric consists of a synthetic fiber and includes a fabric part, and selvages having a predetermined width formed at both ends in the length direction of the fabric part, respectively, wherein the selvage has a fringe protruded from a weft yarn and has a length direction coefficient of variation CV3 (100×standard deviation/average value) of 8.0% or less of the fringe in a length direction of the base fabric.

A jet loom comprises a length measuring device that supplies a weft yarn to a weft yarn supply nozzle for weft-inserting between open warp yarn groups, and a contact pressure adjusting member, wherein the length measuring device comprises a weft yarn catching mechanism for maintaining the weft yarn tension, the weft yarn catching mechanism comprising a first roller that is rotatably supported and rotationally driven by a fixed shaft and a second roller that is rotatably supported by a moving shaft and rotates following the rotation of the first roller by being brought into pressure contact with the first roller, and wherein the contact pressure adjusting member is a member for adjusting the contact pressure of the second roller with respect to the first roller to adjust the shaking width of the moving shaft in the fixed shaft direction during operation to 5-600 μm.

A method of manufacturing a base fabric uses a jet loom comprising a length measuring device that supplies a weft yarn to a weft yarn supply nozzle for weft-inserting between open warp yarn groups, a contact pressure adjusting member, and, on an arrival side fag end of the weft yarn at the time of weft insertion, a pair of weft yarn tension applying members provided opposite to each other across a weft yarn running path, and in a weft yarn catching mechanism for maintaining the weft yarn tension, comprising a first roller which is rotatably supported and rotationally driven by a fixed shaft and a second roller which is rotatably supported by a moving shaft and rotates following the rotation of the first roller by being brought into pressure contact with the first roller, the method comprising a step for adjusting the contact pressure of the second roller with respect to the first roller by the contact pressure adjusting member to adjust the shaking width of the moving shaft in the fixed shaft direction to 5-600 μm and, on the arrival side fag end of the weft yarn at the time of weft insertion, a step for causing a weft yarn running peak tension of 0.4-1.2 cN/dtex to be generated by the weft yarn tension applying member.

DESCRIPTION OF REFERENCE NUMERALS

Figure 1:
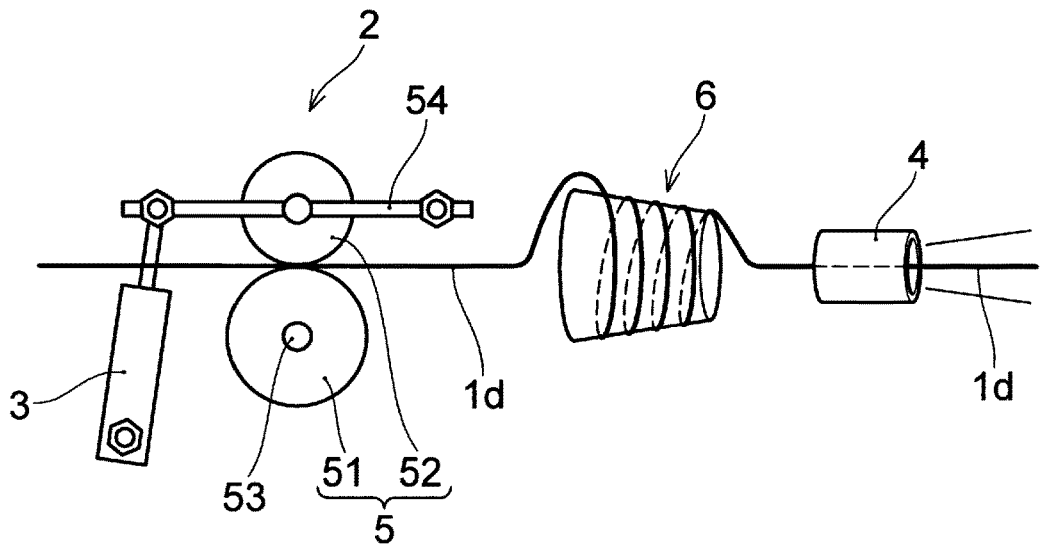
FIG. 1 is a schematic diagram of each component that mainly operates when weft insertion is performed in a jet loom according to an example.

1 Jet loom
1*a* Warp yarn
1*b* Reed
1*c* Temple device
1*d* Weft yarn
1*e* Weft yarn cutter
1*f* Tension applying member
2 Length measuring device
3 Contact pressure adjusting member
4 Weft yarn supply nozzle
5 Weft yarn catching mechanism
51 Length measuring roller
52 Feed roller
53 Fixed shaft
54 Moving shaft
6 Length measuring band

DETAILED DESCRIPTION

Base Fabric

A base fabric in an example has a coefficient of variation CV1 (100×standard/deviation/average value) of 3.0% or less in a length direction of a weft-direction disintegrated yarn strength and a coefficient of variation CV2 (100×standard deviation/average value) of 4.0 or less in a length direction of a weft-direction disintegrated yarn elongation. Such a base fabric has a small variation in both strength and elongation and is of high quality.

The coefficient of variation CV1 (100×standard deviation/average value) in the length direction of the weft-direction disintegrated yarn strength may be 3.0% or less, preferably 2.5% or less, and more preferably 2.0% or less. Furthermore, a lower limit of the coefficient of variation CV1 is not particularly limited. The lower limit of the coefficient of variation CV1 may be 0.5% or more, and preferably 0.1% or more, considering that there is a slight variation in strength at the time of an original yarn before weaving. When the coefficient of variation CV1 exceeds 3.0%, operation of a loom during weaving tends to decrease and the quality of the base fabric tends to deteriorate. In this example, the coefficient of variation CV1 can be calculated by a continuous 20-point measurement of the disintegrated yarn strength from a center in a width direction to a length direction of the base fabric and then from the measured average value and the standard deviation. Moreover, strength of the disintegrated yarn can be measured by JIS fiber L1013 8.5.1 "Chemical fiber filament yarn test method."

The coefficient of variation CV2 (100×standard deviation/average value) in the length direction of the weft-direction disintegrated yarn elongation may be 4.0% or less, preferably 3.5% or less, and more preferably 3.0% or less. Furthermore, a lower limit of the coefficient of variation CV2 is not particularly limited. The lower limit of the coefficient of variation CV2 may be 1.0% or more, and preferably 1.5% or more, considering that there is a slight variation in elongation at the time of an original yarn before weaving. When the coefficient of variation CV2 exceeds 4.0%, operation of a loom during weaving tends to decrease and the quality of the base fabric tends to deteriorate. In this example, the coefficient of variation CV2 can be calculated by a continuous 20-point measurement of the disintegrated yarn elongation from a center in a width direction to a length direction of the base fabric and then from the measured average value and the standard deviation. Moreover, elongation of the disintegrated yarn can be measured by JIS fiber L1013 8.5.1 "Chemical fiber filament yarn test method."

In addition, in the base fabric in this example, in particular, includes a fabric part, and selvages having a predetermined width formed at both ends in a length direction of the fabric part, respectively, a coefficient of variation CV1' (100×standard deviation/average value) in a length direction of a weft-direction disintegrated yarn strength in a width direction including the selvages may be 3.0% or less, and a coefficient of variation CV2' (100×standard deviation average value) in a length direction of a weft-direction disintegrated yarn elongation in a width direction including the selvages may be 4.0 or less.

In this example, the coefficient of variation CV1' (100×standard deviation/average value) in the length direction of the weft-direction disintegrated yarn strength in the width direction including the selvages is preferably 3.0% or less, and more preferably 2.5% or less. Furthermore, a lower limit of the coefficient of variation CV1' is not particularly limited. The lower limit of the coefficient of variation CV1' may be 0.1% or more, and preferably 0.5% or more, considering that there is a slight variation in strength at the time of an original yarn before weaving. When the coefficient of variation CV1' exceeds 3.0%, operation of a loom during weaving tends to decrease and the quality of the base fabric tends to deteriorate. In this example, the coefficient of variation CV1' can be calculated by a continuous 20-point measurement of the disintegrated yarn strength from a selvedge of 5.0 cm in a width direction to a length direction of the base fabric and then from the measured average value and the standard deviation. A sampling position when calculating the coefficient of variation CV1 is not particularly limited. The sampling position may be a sample collected from "the selvedge of 5.0 cm in the width direction of the base fabric" as well as a selvedge of 5.0-30.0 cm in a width direction of the base fabric. Moreover, strength of the disintegrated yarn can be measured by JIS fiber L1013 8.5.1 "Chemical fiber filament yarn test method." In this example, a "selvedge" refers to a portion formed by the outermost warp yarn and the weft yarn in a width direction of the fabric.

The coefficient of variation CV2' (100×standard deviation/average value) in the length direction of the weft-direction disintegrated yarn elongation in the width direction including the selvages may be 4.0% or less, preferably 3.5% or less, and more preferably 3.0% or less. Furthermore, a lower limit of the coefficient of variation CV2' is not particularly limited. The lower limit of the coefficient of variation CV2' may be 1.0% or more, and preferably 1.5% or more, considering that there is a slight variation in elongation at the time of an original yarn before weaving. When the coefficient of variation CV2' is 4.0% or less, the quality of the base fabric becomes good, a base fabric with uniform physical properties can be obtained, and cushion characteristics as designed can be easily obtained. In this example, the coefficient of variation CV2' can be calculated by a continuous 20-point measurement of the disintegrated yarn strength from a selvedge of 5.0 cm in a length direction to a length direction of the base fabric and then from the measured average value and the standard deviation.

Furthermore, the base fabric in this example consists of, in particular, a synthetic fiber, and when including a fabric part, and selvages having a predetermined width formed at both ends in a length direction of the fabric part, respectively, the selvage has a fringe protruded from the weft yarn, and a length direction coefficient of variation CV3 (100× standard deviation/average value) of the fringe in a length direction of the base fabric may be 8.0% or less.

In this example, the length direction coefficient of variation CV3 (100×standard deviation/average value) of the fringe in the length direction is preferably 8.0% or less, and more preferably 7.5% or less. Furthermore, a lower limit of the coefficient of variation CV3 is not particularly limited. The lower limit of the coefficient of variation CV3 has slight variations in strength and elongation at the time of an original yarn before weaving, and considering a variation in an amount of shrinkage to a center in a width direction of the weft yarn immediately after formation of the fringe, it may be 0.1% or more, and preferably 0.5% or more. When the coefficient of variation CV3 is 8.0% or less, the quality of the base fabric becomes good, a base fabric with uniform physical properties can be obtained, and cushion characteristics as designed can be easily obtained. In this example, the coefficient of variation CV3 can be calculated by a 50-point measurement of a length of the fringe with respect to each continuous fringe of the weft yarn arranged along the length direction of the base fabric and then from the average value and the standard deviation.

A raw material composing a base fabric (fiber) is not specifically limited. The fiber composing the base fabric can be appropriately selected according to a product to be manufactured using the base fabric or the like. The fiber may be relatively small, medium, or large in fineness. As an example, when a thin fabric is manufactured with a fiber in a thin fineness using the base fabric in this example and when a base fabric for an airbag is manufactured with a fiber in a medium fineness are shown below.

When a Thin Fabric is Manufactured

In a base fabric, it is preferable to use a thermoplastic synthetic fiber having a total fineness of 5-30 dtex at least for a portion of warp or weft yarns of a woven fabric. The thermoplastic synthetic fiber may be used for both warp and weft yarns.

The thermoplastic synthetic fiber is not particularly limited. As an example, the thermoplastic synthetic fiber is a polyester-based fiber, a polyamide-based fiber, a polyolefin-based fiber, or the like. Examples of the polyester-based fiber include polyethylene terephthalate, polytrimethylene terephthalate, polybutylene terephthalate, polyethylene naphthalate, copolymerized polyester-based fibers mainly composed thereof and the like. Examples of the polyamide-based fiber include nylon 6, nylon 66, and those obtained by copolymerizing a third component and the like. Examples of the polyolefin-based fiber include polypropylene and polyethylene and the like. The thermoplastic synthetic fiber is preferably a polyester-based fiber especially from a viewpoint of excellent heat resistance and dyeability and is also preferably a polyamide-based fiber from a viewpoint of excellent softness, among them. Fibers other than the thermoplastic synthetic fiber may be used for a portion of base fabrics.

In an example when the base fabric is used for a thin fabric or the like, a molecular weight of the thermoplastic synthetic fiber is preferably large. In addition, a molecular weight of the polymer composing the thermoplastic synthetic fiber can be usually represented with viscosity. Therefore, the polymer of the thermoplastic synthetic fiber preferably has a high viscosity. As an example, in a polyester-based fiber, an intrinsic viscosity [η] is preferably 0.65 or more, and more preferably 0.8 or more. Furthermore, the intrinsic viscosity [η] is preferably 1.30 or less, and more preferably 1.1 or less. In this example, the intrinsic viscosity [η] refers to a limiting viscosity measured per 1% by weight in orthochlorophenol. When the intrinsic viscosity [η] is within the above-described range, even in polyester-based fibers having a thin yarn fineness as those used in thin fabrics and the like, the above-described ranges of the coefficient of variation in strength and elongation are easily achieved. In particular, when the intrinsic viscosity [η] is 0.65 or more, yarn strength and abrasion strength of the yarn increase, and in particular, tear strength and abrasion strength can be also sufficient when a yarn having a thin single-yarn fineness is used for a woven fabric. On the other hand, when the intrinsic viscosity [η] is 1.3 or less, a problem that texture becomes hard when the yarn is used for the base fabric is less likely to occur.

In the polyamide-based fiber, a relative viscosity is preferably 2.5 or more, and more preferably 2.6 or more. Furthermore, the relative viscosity is preferably 3.5 or less, and more preferably 3.4 or less. In this example, the relative viscosity is obtained by dissolving polymer or prepolymer in 85.5% of a special grade concentrated sulfuric acid at a polymer concentration of 1.0 g/dl and determining a solution relative viscosity with an Ostwald viscometer at 25° C. When the relative viscosity is 2.5 or more, yarn strength and abrasion strength of the yarn increase, and in particular, tear strength and abrasion strength can be sufficient when a yarn having a thin fineness is used for a woven fabric. On the other hand, when the relative viscosity is 3.5 or less, a problem that texture becomes hard when the yarn is used for the base fabric is less likely to occur.

When the base fabric is used for a thin fabric or the like, the total fineness of the fibers used for a portion of the warp or the weft yarns is preferably 3 dtex or more, and more preferably 5 dtex or more. Furthermore, the total fineness is preferably 70 dtex or less, and more preferably 50 dtex or less. When the total fineness is within the above-described ranges, thin fabrics obtained have an appropriate thickness, are durable, and are less likely to become hard.

The single-yarn fineness is preferably 0.5 dtex or more, and more preferably 0.7 dtex or more. Furthermore, the single-yarn fineness is preferably 6.0 dtex or less, and more preferably 2.5 dtex or less. When the single-yarn fineness is within the above-described ranges, thin fabrics obtained have a low air permeability and easily obtain a soft texture.

A shape of a single-yarn cross section of a fiber is not particularly limited. As a cross sectional shape of a single fiber of a synthetic fiber, a flat cross section can be used in addition to a round cross section. By using a fiber having a flat cross section, it becomes possible to fill the fiber with a high density when it is made into a woven fabric, reducing the space occupied between single fibers in the woven fabric, and when the same woven fabric structures are used, it becomes possible to suppress an amount of air permeation to be lower, as compared to round cross sectional yarns in an equivalent fineness are used.

Furthermore, as for the shape of the flat cross section, when the cross section of the single fiber is approximated to an ellipse, a flatness defined by a ratio (D1/D2) of the long diameter (D1) to the short diameter (D2) is preferably 1.5 or more, and more preferably 2.0 or more. Moreover, the flatness is preferably 4 or less, and more preferably 3.5 or less. The flat cross sectional shape may be a geometrically true elliptical shape as well as, for example, a rectangular, rhombus, or cocoon shape, and it may be a laterally symmetrical or a laterally asymmetrical shape. Also, it may be a combination combining any of these. In addition, the cross sectional shape may have a protrusion, a dent, or a partially hollow portion based on the above-described basic shapes.

For example, when a fiber has a W-shaped cross section or a V-shaped cross section in the cross sectional shape, the fiber is arranged in a brick-laid structure when made into a base fabric, exhibits a structure similar to closest packing, and a gap between single yarns becomes smaller, allowing for reduction of air permeability. Furthermore, when the fiber is a single yarn in a flat shape such as a W-shaped cross section, a base fabric having a soft texture can be easily obtained due to an effect of reducing a bending stress caused by a yarn.

In addition, when the fiber has a modified cross section such as a W-shaped cross section, a V-shaped cross section, or a spectacle-shaped cross section, and has a groove (that is, a concave portion in a single-yarn cross section), it has excellent sweat-absorbing and quick-drying properties as a base fabric and is appropriate for base fabrics for clothes and bedding side fabrics and the like with a dry touch even having sweats.

When the base fabric is used for a thin fabric or the like, a basis weight of the base fabric is preferably 15 g/m$^2$ or more, and more preferably 20 g/m$^2$ or more. The basis weight of the base fabric is preferably 120 g/m$^2$ or less, and more preferably 100 g/m$^2$ or less. When the basis weight of the base fabric is within the above-described ranges, the base fabric is durable and easily gives a lightweight feeling when the base fabric is used as a sports clothing or a bedding side fabric, particularly as a down jacket or a down bedding side fabric.

A structure of the base fabric in this example is not particularly limited as long as the base fabric defined in this example can be obtained. As an example, it is particularly preferable that the structure of the base fabric is a plain weave structure when used for a thin fabric. A weaving density of the base fabric can be changed depending on whether the base fabric is resin-processed or not, or on a fineness of a woven yarn or the like. As an example, in a plain structure, a cover factor is preferably 500 or more, and more preferably 550 or more. Furthermore, the cover factor is preferably 3,000 or less, and more preferably 2,500 or less. It is preferable the cover factor is within the above-described ranges from viewpoints of a low air permeability, flexibility, shift of seams, and lightness. The cover factor of the base fabric refers to a sum of values calculated by multiplying a square root of a yarn thread fineness by the number of yarn thread per inch for each of warp and weft yarns. That is, the cover factor (CF) of the woven fabric is represented by the following formula when a total fineness of the warp yarn is shown as Dw (dtex), a total fineness of the weft yarn is shown as Df (dtex), a weaving density of the warp yarn as Nw (yarns/2.54 cm), and a weaving density of the weft yarn as Nf (yarns/2.54 cm):

$$CF=(Dw)^{1/2}\times Nw+(Df)^{1/2}\times Nf.$$

As described above, the base fabric in this example has the coefficient of variation CV1 of 3.0% or less in the length direction of the weft-direction disintegrated yarn strength and the coefficient of variation CV2 of 4.0% or less in the length direction of the weft-direction disintegrated yarn elongation. Therefore, the base fabric has small variations in both strength and elongation and is of high quality. Furthermore, even when such a base fabric is made of a material that easily causes unevenness in dyeing such as, for example, nylon, it has small variations in both strength and elongation so that unevenness in dyeing hardly occurs during dyeing. Thus, the base fabric in this example is appropriate, for example, for daily use such as general clothing using thin fabrics, sports clothing, clothing materials, interior products such as carpets, sofas, and curtains, vehicle interior products such as car seats, cosmetics, cosmetic masks, wiping cloths, and health supplies, and for use of environmental and industrial materials such as filters and hazardous substance removal products.

When an Airbag is Manufactured

A ground part of the base fabric may be composed of a synthetic fiber multifilament. The synthetic fiber is not particularly limited. As an example, the synthetic fiber is a polyamide-based fiber, a polyester-based fiber, an aramid-based fiber, a rayon-based fiber, a polysulfone-based fiber, or an ultrahigh molecular weight polyethylene-based fiber, or the like. The synthetic fiber is preferably a polyamide-based fiber or a polyester-based fiber having excellent mass productivity and economy, among them.

Examples of the polyamide-based fiber include fibers consisting of nylon 6, nylon 66, nylon 12, nylon 46, a copolymer polyamide of nylon 6 and nylon 66, a copolymer polyamide obtained by copolymerizing nylon 6 with polyalkylene glycol, dicarboxylic acid, amine or the like. Among them, a nylon 6 fiber and a nylon 66 fiber are preferable because of their particularly excellent strength.

Examples of the polyester-based fiber include fibers consisting of polyethylene terephthalate, polybutylene terephthalate and the like. The polyester-based fiber may be fibers consisting of a copolymer polyester obtained by copolymerizing polyethylene terephthalate or polybutylene terephthalate with an aliphatic dicarboxylic acid such as isophthalic acid, 5-sodium sulfoisophthalic acid, or adipic acid as an acid component.

These synthetic fibers may contain additives such as a thermal stabilizer, an antioxidant, a light stabilizer, a smoothing agent, an antistatic agent, a plasticizer, a thickener, a pigment, and a flame retardant to improve productivity or properties in a spinning/stretching process and a working process.

The cross sectional shape of the single fiber of the synthetic fiber may be a round cross section as well as a flat cross section. By using a fiber having a flat cross section, it becomes possible to fill the fiber with a high density when made into a woven fabric, reducing the space occupied between single fibers in the woven fabric, and when the same woven fabric structures are used, it becomes possible to suppress an amount of air permeation required for airbag use to be lower, as compared to round cross sectional yarns in an equivalent fineness are used.

As for the shape of the flat cross section, when the cross section of the single fiber is approximated to an ellipse, a flatness defined by a ratio (D1/D2) of the long diameter (D1) to the short diameter (D2) is preferably 1.5 or more, and more preferably 2.0 or more. Moreover, the flatness is preferably 4 or less, and more preferably 3.5 or less. The flat cross sectional shape may be a geometrically true elliptical shape as well as, a rectangular, rhombus, cocoon shape or the like, and it may be a laterally symmetrical or a laterally asymmetrical shape. Also, it may be a combination combining any of these. In addition, the cross sectional shape may be a shape with a protrusion, a dent, or a partially hollow portion formed based on the above-described basic shapes.

When the base fabric is used for an airbag or the like, a basis weight of the base fabric is preferably 110 g/m$^2$ or more, and more preferably 120 g/m$^2$ or more. Furthermore, the basis weight of the base fabric is preferably 240 g/m$^2$ or less, and more preferably 230 g/m$^2$ or less. When the basis weight of the base fabric is within the above-described ranges, it is durable and capable of suppressing an amount of air permeation to be smaller when used for an airbag.

In the base fabric in this example, it is usually preferable that the same synthetic fiber yarn is used as a warp yarn and a weft yarn. The description that "the same synthetic fiber yarn is used as a warp yarn and a weft yarn" means that the warp and weft yarns consist of the same type of polymer, have the same single-yarn fineness, and have the same total fineness. The same type of polymer refers to polymers having a common main repeating unit of polymers such as nylons 66, polyethylene terephthalates and the like. As an example, even a combination of a homopolymer and a copolymer is preferably used as the same type of polymer in this example. Furthermore, it is preferable for production management to have the same combination of presence or absence of copolymer components, and a type and an amount of copolymer components if the polymers are copolymerized, which requires no distinction between warp and weft yarns.

A single-fiber fineness of a synthetic fiber yarn used as a ground yarn of the base fabric in this example is preferably 1-7 dtex of a synthetic fiber filament. When the single-yarn fineness is 7 dtex or less, the space occupied between the single fibers in the base fabric obtained becomes reduced, further improving the filling effect of the fiber. As a result, the air permeability of the base fabric becomes easy to decrease. Moreover, when the single-yarn fineness is 7 dtex or less, an effect of reducing the rigidity of the synthetic fiber filament can be obtained. Therefore, an air bag using the base fabric obtained is easy to improve the storability.

A total fineness of the synthetic fiber yarn used as a ground yarn of the woven fabric is preferably 100 dtex or more, and more preferably 150 dtex or more. Furthermore, the total fineness is preferably 1,000 dtex or less, and more preferably 800 dtex or less. When the total fineness is within the above-described ranges, the base fabric obtained is excellent in strength, air permeability and slippage resistance. Moreover, the airbag using the base fabric obtained is easy to maintain compactness at the time of storage and a low air permeability. The fineness is a value measured based on corrected mass with a predetermined load of 0.045 cN/dtex according to a JIS L 1013: 2010 8.3.1 A method.

When the base fabric in this example is used for an airbag, a tensile strength of a fiber composing the base fabric is preferably 8.0 cN/dtex or more, more preferably 8.3 cN/dex or more for both warp and weft yarns, from the fact that the base fabric satisfies the mechanical characteristics required as a fabric for an airbag base fabric, and in terms of yarn-making operability. Furthermore, the tensile strength is preferably 9.0 cN/dtex or less, and more preferably 8.7 cN/dtex or less. The tensile strength can be measured by JIS L 1096: 8.15.5 D method (Benjuram method).

A structure of the base fabric in this example is not particularly limited as long as the base fabric defined in this example can be obtained. As an example, it is particularly preferable that the structure of the base fabric is a plain weave structure when used for an airbag, from a viewpoint of compact storability. A weaving density of the base fabric can be changed depending on whether the base fabric is resin-processed or not, or on a fineness of a woven yarn or the like. As an example, a cover factor is preferably 1,500 or more, and more preferably 1,800 or more. Furthermore, the cover factor is preferably 2,800 or less, and more preferably 2,500 or less. When the cover factor is within the above-described ranges, the base fabric can easily achieve both a low air permeability and a high slippage resistance. The definition of the cover factor is as described above with respect to when the structure of the base fabric is used for a thin fabric.

When the base fabric in this example is used for an airbag, the structure of the base fabric is preferably a plain weave structure. The structure of the base fabric may be twill weave, sateen weave, or the like depending on the characteristics required for the base fabric, and an order of passing through healds and the number of threads passing through reeds are appropriately determined depending on the fabric structure.

A width of the base fabric is preferably 160 cm or more, and more preferably 180 cm or more. Moreover, the width of the base fabric is preferably 260 cm or less, and more preferably 250 cm or less. When the width of the base fabric is within the above-described ranges, the base fabric is less likely to be lost during cutting when manufacturing an airbag. The "width of the base fabric" is a width of a fabric part of a base fabric excluding a selvage.

As described above, the base fabric in this example has the coefficient of variation CV1 of 3.0% or less in the length direction of the weft-direction disintegrated yarn strength and the coefficient of variation CV2 of 4.0% or less in the length direction of the weft-direction disintegrated yarn elongation. Therefore, the base fabric has small variations in both strength and elongation and is of high quality, making it appropriate, for example, as a base fabric for an airbag.

Jet Loom

Figure 2:
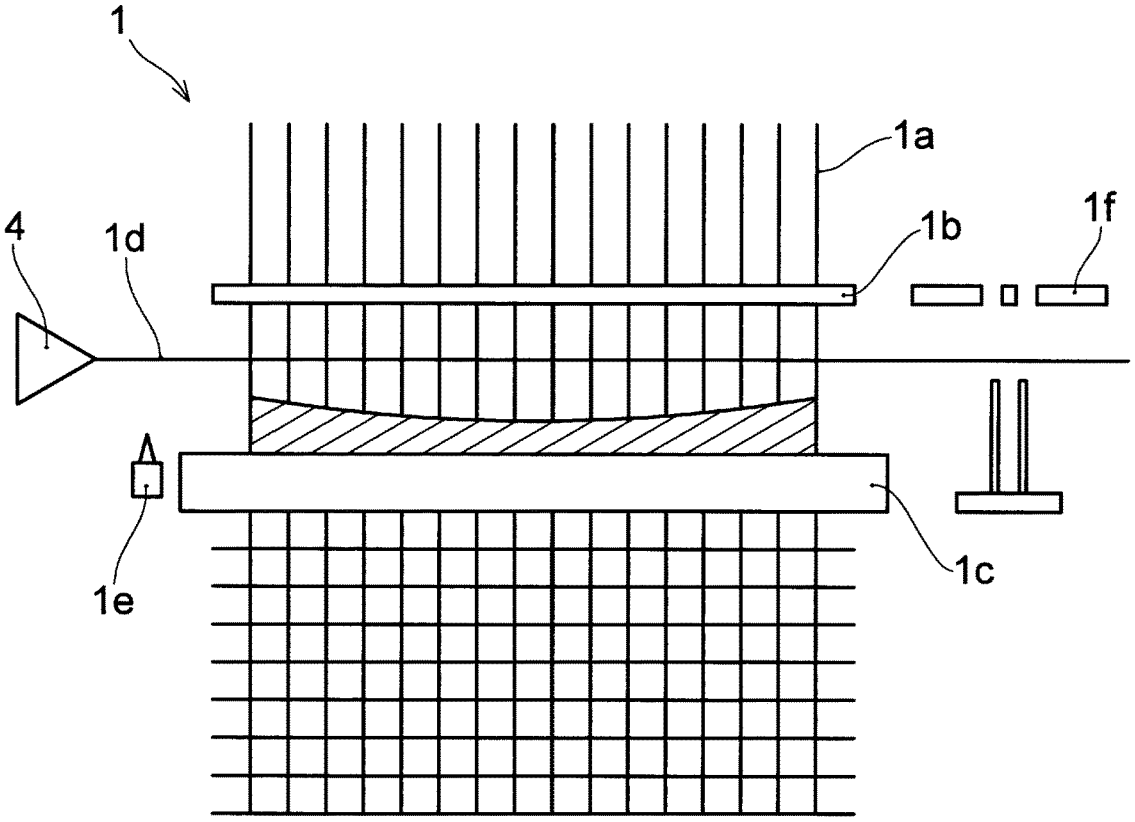
FIG. 2 is a schematic plan view of a jet loom according to an example.

The jet loom in an example is a jet loom for weaving a base fabric. FIG. 1 is a schematic diagram of each component that mainly operates when weft insertion is performed in a jet loom according to this example. FIG. 2 is a schematic plan view of a jet loom 1 according to this example. In FIG. 2, for clarity of explanation, the configuration arranged on the upstream side of the weft yarn nozzle shown in FIG. 1 is omitted. As shown in FIG. 1, the jet loom includes a length measuring device 2 that supplies a weft yarn to a weft yarn supply nozzle 4 for weft-inserting between open warp yarn groups, a contact pressure adjusting member 3, and a drive (not shown). Each of these components is driven mainly during weft insertion. Furthermore, as shown in FIG. 2, the jet loom 1 is supplied from a warp yarn-feeding device (not shown), and mainly comprises a plurality of warp yarns 1*a* aligned in a longitudinal direction, a reed 1*b* through which the warp yarns 1*a* are passed, a temple device 1*c* disposed on an downstream side of the reed 1*b*, a weft yarn supply nozzle 4 disposed between the reed 1*b* and the temple device 1*c*, a weft yarn 1*d* in which the warp yarns 1*a* are appropriately delivered from the weft yarn supply nozzle 4 in a direction orthogonal to each other and which is weft-inserted between the warp yarns 1*a*, and a weft yarn cutter 1*e* for cutting the weft yarn 1*d* beaten up in a direction of the temple device 1*c* with the reed 1*b*. The weft yarn 1*d* beaten up by the weft supply nozzle 4 is caught by a pair of tension applying members if provided opposite to each other across a weft yarn running path, on an arrival side fag end, maintaining the appropriate weft yarn tension until the beating with the reed 1*b* ends. The weft supply nozzle 4 utilizes injection of fluid such as high-pressure water or compressed air when supplying the weft yarn 1*d*. In this example, a jet room (water jet room) utilizing high-pressure water will be described as an example. The jet loom in this example is particularly characterized in that the above-described contact pressure adjusting member 3 is provided. In addition, the jet loom in this example is appropriate as a jet loom for weaving the base fabric as explained in detail in the example above.

First, prior to explanation of this example, problems of a general jet loom will be described. In a general jet loom, the warp yarns 1*a* are appropriately delivered from the weft supply nozzle 4 in a direction orthogonal to each other and weft-inserted between the opened warp yarn 1*a* groups. The weft-inserted weft yarn 1*d* is beaten by the reed 1*b* and both ends thereof are cut. In general, in a jet loom, these series of operations are linked at high speed. The number of rotation of the jet loom is, for example, 500 rpm or more, and preferably 700 rpm. Therefore, for example, vibration during reed beating propagates to other components (for example, the length measuring device 2). Such vibration propagation is particularly noticeable when the number of rotation exceeds 600 rpm.

As shown in FIG. 1, the length measuring device 2 comprises a weft yarn catching mechanism 5 for maintaining the weft yarn tension. This weft yarn catching mechanism 5 comprises a length measuring roller 51 (an example of a first roller) and a feed roller 52 (an example of a second roller). The length measuring roller 51 is a roller that is rotationally driven by a drive and is rotatably fixed to a fixed shaft 53. On the other hand, the feed roller 52 is a roller that is rotatably supported by a moving shaft 54, which is not fixed, and catches the weft yarn 1*d* by coming into contact with the length measuring roller 51. In accordance with the size and the number of rotation of the length measuring roller 51, a predetermined length of the weft yarn 1*d* is wound around a length measuring band 6 and then sent to the weft supply nozzle 4.

As described above, when vibration such as reed beating propagates, the feed roller 52 may rise up (jumping) with respect to the length measuring roller 51. In this example, in a conventional jet loom that does not comprise the contact pressure adjusting member 3, the feed roller 52 and the length measuring roller 51 could not appropriately catch the weft yarn 1*d*, and the weft yarn 1*d* having a predetermined length could not be correctly wound up. Furthermore, the feed roller 52 might be worn by continued use. Even in this example, the contact pressure of the feed roller 52 with respect to the length measuring roller 51 might change, and the weft yarn 1*d* could not be appropriately caught.

As a result, in the conventional jet loom that does not comprise the contact pressure adjusting member 3, it was necessary to measure and take an excessive length of the weft yarn 1*d* that was somewhat longer than the width of the base fabric and to supply it to the weft supply nozzle 4. That is, the weft supply nozzle 4 supplied the weft yarn 1*d* that was somewhat longer than the width of the base fabric, and then cut the end of the weft yarn 1*d*. Therefore, the length of the end of the weft yarn 1*d* cut was long, generating a number of fiber wastes.

As such, even though the excessive length of the weft yarn 1*d* was supplied, the problem that the predetermined length of the weft yarn 1*d* cannot be correctly wound up has not been solved. For this reason, the weft yarn 1*d* run from the weft supply nozzle 4 had large variations in the length direction of the weft-direction disintegrated yarn strength and in the length direction of the weft-direction disintegrated yarn elongation, and thus the quality of the base fabric obtained was not excellent. Furthermore, there was also large variation in the length of the fringe formed by cutting the end of the weft yarn 1*d*, which contributed to the variations in the length directions of the weft-direction disintegrated yarn strength and the weft-direction disintegrated yarn elongation.

In contrast, the jet loom in this example comprises a contact pressure adjusting member 3 for adjusting the contact pressure of the feed roller 52 with respect to the length measuring roller 51 to adjust the shaking width of the moving shaft 54 in the fixed shaft 53 direction during operation to 5-600 μm and a tension applying member if for adjusting a weft yarn running peak tension by weft yarn catching at the time of weft insertion to 0.4-1.2 cN/dtex.

The contact pressure adjusting member 3 is a relatively long member having one end connected to the moving shaft 54 to which the feed roller 52 is attached and the other end connected to the vicinity of the feed roller 52, the other end being a part of the jet loom. The contact pressure adjusting member 3 is configured to pull the moving shaft 54 toward the length measuring roller 51 side so that the feed roller 52 is pressed against the length measuring roller 51.

A configuration of the contact pressure adjusting member 3 is not particularly limited. As an example, the contact pressure adjusting member 3 appropriately comprises a tension spring for adjusting the contact pressure of the feed roller 52 with respect to the length measuring roller 51 (an example of an urging member, not shown), and a member for adjusting the mounting length of the tension spring (an example of the urging member, not shown), and a vibration absorbing member for mitigating vibration such as reed beating (not shown). The vibration absorbing member is a part for mitigating vibration and composing polymer materials with elasticity such as natural rubber, nitrile rubber, butyl rubber fluororubber, urethane rubber, ethylene propylene rubber, hydrogenated nitrile rubber, chloropropylene rubber, and acrylic rubber, or damper mechanisms such as a spring damper, a gas spring, and a hydraulic damper. The vibration absorbing member suppresses propagation of vibration to other parts of the contact pressure adjusting member 3 (particularly, a tension spring or one end part connected to the moving shaft 54). A quality of the material of the main body of the contact pressure adjusting member 3 is not particularly limited. The main body of the contact pressure adjusting member 3 preferably has a quality of the material that can withstand vibration from the jet loom and has rigidity and durability which can be pressed against the feed roller 52. As an example, a quality of the material of the main body is stainless steel, chromium molybdenum steel, aluminum alloy or the like.

The pressure contact force of the feed roller 52 with respect to the length measuring roller 51 is appropriately adjusted when the contact pressure adjusting member 3 is attached to the feed roller 52. Specifically, the shaking width of the moving shaft 54 in the fixed shaft 53 direction during operation of the jet loom is adjusted to be 5-600 μm. Furthermore, the shaking width is preferably adjusted to be 5 μm or more, and more preferably 10 μm or more. Moreover, the shaking width is preferably adjusted to be 600 μm or less, and more preferably 400 μm or less. When the shaking width is less than 5 μm, the roller wear tends to noticeably progress. On the other hand, when the shaking width exceeds 600 μm, the jet loom hardly keeps the contact pressure of the feed roller 52 with respect to the length measuring roller 51 constant, and the predetermined length of the weft yarn 1*d* tends not to be correctly wound up. The shaking width refers to a distance when the feed roller 52 rises up by vibration with respect to the length measuring roller 51.

The weft yarn tension applying member if is provided opposite to each other across the weft yarn running path, on the arrival side fag end of the weft yarn at the time of weft insertion. As shown in FIG. 2, the weft yarn tension applying member 1*f* includes plate members that protrude toward the reed 1*b* side and members in which a slit is formed in a part facing these plate members. When the weft yarn is reed-beaten, the tip of the weft yarn is pushed into the slit by the plate members. Thus, tension is applied to the weft yarn.

A material of the weft yarn tension applying member 1*f* is not particularly limited. As an example, since, in the material of the weft yarn tension applying member 1*f*, excessive tension is not applied to the weft yarn, satin processing, uneven processing, roughening processing, knurling processing or the like may be applied to a part where the plate member comes into contact with the weft yarn.

Figure 3:
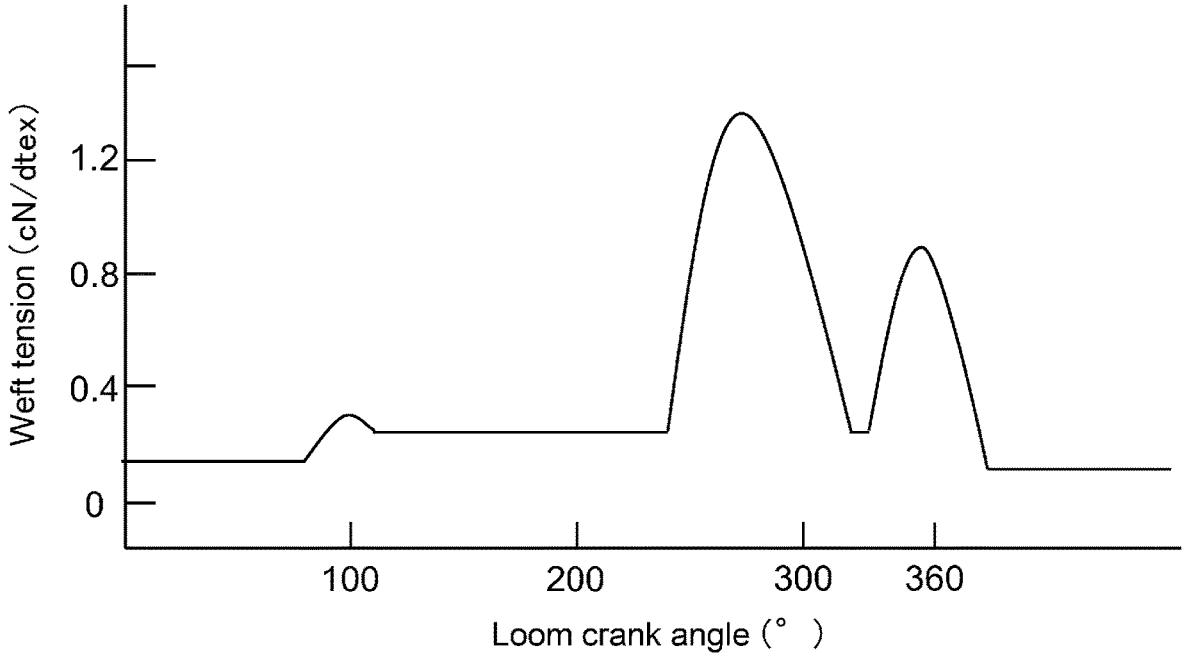
FIG. 3 is a graph showing a weft yarn tension and a crank angle of a loom at the time of weft insertion obtained in a jet loom according to an example.

The weft yarn running peak tension generated by the tension applying member 1*f* is preferably 0.4-1.2 cN/dtex, and more preferably 0.6-1.0 cN/dtex. When the weft yarn running peak tension generated by the tension applying member 1*f* is less than 0.4 cN/dtex, the weft yarn is insufficiently caught, and the loom tends to malfunction. On the other hand, when the weft yarn running peak tension generated by the tension applying member 1*f* exceeds 1.2 cN/dtex, too much tension is excessively applied to the weft yarn, and the weft yarn tends to have a poor quality such as having sink marks or stripes as a woven fabric. FIG. 3 is a graph showing a weft yarn tension and a crank angle of a loom at the time of weft insertion obtained in the jet loom according to this example. In this example, the weft yarn running peak tension generated by the weft yarn tension applying member 1*f* refers to a peak tension generated at a loom crank angle of around 330-360°.

As such, the jet loom in this example can catch the weft yarn 1*d* with an appropriate contact pressure by the length measuring roller 51 and the feed roller 52 in the length measuring device 2. Therefore, even if the dimension or the like of the length measuring roller 51 is changed, the contact pressure adjusting member 3 maintains the contact pressure of the feed roller 52 with respect to the length measuring roller 51 to be constant. As a result, the weft yarn 1*d* is uniformly supplied to the weft supply nozzle 4. In addition, the jet loom in this example is provided with a weft yarn tension applying member if so that the weft yarn at the time of weft insertion can be securely caught by the weft yarn tension applying member 1*f*, and the appropriate weft yarn tension can be maintained until reed beating is completed. Consequently, a high-quality base fabric with small variations in strength and elongation can be obtained, and the amount of fiber wastes generated during weft insertion can be reduced.

Method of Manufacturing a Base Fabric

A method of manufacturing a base fabric according to an example uses the jet loom comprising the length measuring device that supplies the weft yarn to the weft yarn supply nozzle for weft-inserting between the open warp yarn groups, the contact pressure adjusting member and, on the arrival side fag end of the weft yarn at the time of weft insertion, the pair of weft yarn tension applying members provided opposite to each other across the weft yarn running path. In a weft yarn catching mechanism that maintains the weft yarn tension, comprising a length measuring roller rotatably supported and rotationally driven by a fixed shaft and a feed roller which is rotatably supported by a moving shaft and rotates following the rotation of the length measuring roller by being brought into pressure contact with the length measuring roller when weft-inserting between the open warp yarn groups, the method of manufacturing the base fabric comprises a step of adjusting the contact pressure of the feed roller with respect to the length measuring roller by the contact pressure adjusting member to adjust the shaking width of the moving shaft in the fixed shaft direction to 5-600 μm and, on the arrival side fag end of the weft yarn at the time of weft insertion, a step for causing a weft yarn running peak tension of 0.4-1.2 cN/dtex to be generated by the weft yarn tension applying member. The method of manufacturing the base fabric in this example may adopt other configurations adopted in the conventional methods of manufacturing the base fabric, in addition to such steps of adjusting the contact pressure and weft-inserting. Additionally, the method of manufacturing the base fabric in this example is appropriate as a method of manufacturing the base fabric described in detail in the above-described example.

That is, first, synthetic fiber filament yarns are used as warp and weft yarns to arrange warp yarns having a fineness according to a woven fabric design and subject them to a loom. Weft yarns are prepared in a similar way as performed for the warp yarns above. A synthetic fiber filament yarn thread used for the warp and weft yarns is preferably the same for post-process in terms of the quality of the base fabric. A water jet loom is preferably used for the jet loom since it reduces occurrence of warp yarn fluff, relatively makes easy for high-speed weaving, and increases productivity.

In this example, the warp yarn tension is preferably adjusted to 50 cN/yarn or more, and more preferably 100 cN/yarn or more. Furthermore, the warp yarn tension is preferably adjusted to 250 cN/yarn or less, more preferably 200 cN/yarn or less. When the warp yarn tension is adjusted within the above-described ranges, a gap between single fibers in a yarn bundle of multifilament yarns composing a woven fabric is easy to be reduced, and an amount of air permeation of the base fabric obtained is easy to be decreased. Moreover, after beating up the weft yarn, the warp yarn, to which the tension described above is applied, pushes the weft yarn to bend so that a structure-restraining force of the woven fabric in the weft yarn direction is easy to be enhanced, a seam slip resistance of the woven fabric improves, and air leakage due to a seam slip of a sewn portion when forming a bag body as an airbag is easy to be suppressed. Examples of the method of adjusting the warp yarn tension within the above-described ranges include a method of adjusting a warp yarn forwarding speed of a loom, a method of adjusting a weft yarn beating speed, and the like. Whether the warp yarn tension is actually within the above-described ranges during weaving can be confirmed, for example, by measuring tension applied per one warp yarn with a tension measuring instrument between a warp yarn beam and a back roller during operation of the loom.

Furthermore, it is preferable to make a difference between an upper yarn sheet tension and a lower yarn sheet tension at a warp yarn opening. Examples of a method of adjusting them include a method of making a difference between running line lengths of the upper yarn and the lower yarn by generally setting the back roller height at a position, for example, 10-30 mm higher than a horizontal position or the like. Moreover, examples of the other method of making a difference between the upper yarn sheet tension and the lower yarn sheet tension include, for example, a method of making a dwell angle for one side of the upper yarn/the lower yarn 100 degrees greater than that for the other side by adopting a cam drive system in an opening device.

Next, the above-described jet loom is used to perform opening, weft insertion, reed beating, winding and the like in conjunction. As described above, in the method of manufacturing the base fabric according to this example, the jet loom can catch the weft yarn with an appropriate contact pressure by the feed roller and the length measuring roller in the length measuring device. Therefore, even if the dimension or the like of the length measuring roller is changed, the contact pressure adjusting member maintains the contact pressure of the feed roller with respect to the length measuring roller to be constant. As a result, the weft yarn is uniformly supplied to the weft supply nozzle. Consequently, a high-quality base fabric with small variations in strength and elongation can be obtained, and the amount of fiber wastes generated during weft insertion can be reduced. The above-described steps are performed in the conventional manner except that the jet loom described above is used at the time of weft insertion.

The method of manufacturing the woven fabric according to this example may adopt processing steps such as scouring and heat setting as necessary after the above-described steps. In particular, when a small amount of air permeation is required such as for an airbag use, the obtained base fabric may be coated with a resin or the like on the surface of the base fabric, or may be formed into a coated fabric with a film attached thereto.

Furthermore, a method of manufacturing an airbag from the base fabric obtained by the method of manufacturing the base fabric according to this example is not particularly limited. As an example, the airbag can be manufactured by cutting the base fabric according to a cutting pattern, sewing it into a bag shape, and attaching an accessory device such as an inflator. The airbag obtained can be used for a driver's seat, a passenger seat, a rear seat, a side surface, a knee, a ceiling or the like. The airbag obtained is appropriately used particularly as a driver seat or a passenger seat requiring a large restraining force. Cutting the base fabric is usually performed by laminating a plurality of resin-processed woven fabrics and punching them with a knife. Moreover, in a non-coated base fabric, since cutting by punching with a knife causes an end of a cut product to become easily frayed, the base fabric is usually cut one by one with a laser cutter. The base fabric in this example can be adjusted so that the length of the fringe becomes uniform by using the above-described jet loom. Therefore, the base fabric is easily cut into a shape as designed and sewed as well. As a result, the airbag obtained is formed as designed to be finished into an accurate form and is functionally excellent such that it has a high burst strength. In addition, since the base fabric used for the airbag has a uniform length of the fringe, the amount of fiber wastes to be discarded is small, which is also advantageous in terms of cost.

Thus far, examples have been described. This disclosure is not particularly limited to the above-described examples. The above-described examples are mainly for explanation having the following configurations.

(1) A base fabric having a coefficient of variation CV1 (100×standard deviation/average value) of 3.0% or less in a length direction of a weft-direction disintegrated yarn strength and a coefficient of variation CV2 (100×standard deviation/average value) of 4.0 or less in a length direction of a weft-direction disintegrated yarn elongation.

According to such a configuration, the base fabric has small variations in both strength and elongation and is of high quality. Furthermore, even when such a base fabric is made of, for example, nylon or the like, it hardly causes unevenness in dyeing at the time of dyeing. Moreover, since the base fabric has small variations in strength and elongation, it is appropriate as, for example, a base fabric for an airbag.

(2) A base fabric including a fabric part, and selvages having a predetermined width formed at both ends in a length direction of the fabric part, respectively, and having a coefficient of variation CV1' (100×standard deviation/average value) of 3.0% or less in a length direction of a weft-direction disintegrated yarn strength in a width direction including the selvages and a coefficient of variation CV2' (100×standard deviation average value) of 4.0 or less in a length direction of a weft-direction disintegrated yarn elongation in a width direction including the selvages.

According to such a configuration, the base fabric has small variations in both strength and elongation, even in the selvages that easily cause variations in strength and elongation, and is of extremely high quality.

(3) A base fabric consisting of a synthetic fiber, including a fabric part, and selvages having a predetermined width formed at both ends in a length direction of the fabric part, respectively, wherein the selvage has a fringe protruded from a weft yarn, and having a length direction coefficient of variation CV3 (100×standard deviation/average value) of 8.0% or less of the fringe in a length direction of the base fabric.

According to such a configuration, the base fabric has a uniform length of the fringe in the length direction of the base fabric. That is, in the base fabric, the weft yarn is beaten with a uniform tension. For this reason, the base fabric has a fixed length of the weft yarn to be beaten at the time of weaving and hardly generates excess fiber wastes.

(4) The base fabric of any one of (1) to (3), which is used for an airbag.

According to such a configuration, since the base fabric has small variations in strength and elongation, it is appropriate as, for example, a base fabric for an airbag.

(5) A jet loom comprising a length measuring device that supplies a weft yarn to a weft yarn supply nozzle for weft-inserting between open warp yarn groups, and a contact pressure adjusting member, wherein the length measuring device comprises a weft yarn catching mechanism that maintains the weft yarn tension, the weft yarn catching mechanism comprising a first roller that is rotatably supported and rotationally driven by a fixed shaft and a second roller that is rotatably supported by a moving shaft and rotates following the rotation of the first roller by being brought into pressure contact with the first roller, and wherein the contact pressure adjusting member is a member that adjusts the contact pressure of the second roller with respect to the first roller to adjust the shaking width of the moving shaft in the fixed shaft direction during operation to 5-600 μm.

According to such a configuration, the jet loom can catch the weft yarn with an appropriate contact pressure by the first roller and the second roller in the length measuring device. Even if the dimension or the like of the first roller is changed, the contact pressure adjusting member maintains the contact pressure of the second roller with respect to the first roller to be constant. As a result, the weft yarn is uniformly supplied to the weft supply nozzle. Consequently, a high-quality base fabric with small variations in strength and elongation can be obtained, and the amount of fiber wastes generated during weft insertion can be reduced.

(6) The jet loom of (5), wherein the contact pressure adjusting member comprises an urging member that adjusts the contact pressure of the second roller with respect to the first roller and a vibration absorbing member for mitigating vibration generated by the jet loom.

According to such a configuration, the contact pressure of the second roller with respect to the first roller is likely to be appropriately adjusted by the urging member. Furthermore, vibration propagated in connection with reed beating or the like is likely to be appropriately absorbed by the vibration absorbing member. As a result, the weft yarn is more uniformly supplied to the weft supply nozzle. Consequently, a high-quality base fabric with small variations in strength and elongation can be obtained, and the amount of fiber wastes generated at the time of weft insertion can be reduced.

(7) The jet loom of (5) or (6), comprising, on an arrival side fag end of the weft yarn at the time of weft insertion, a pair of weft yarn tension applying members provided opposite to each other across a weft yarn running path.

According to such a configuration, it is possible to securely catch the weft yarn at the time of weft insertion and maintain the appropriate weft yarn tension until reed beating is completed. As a result, a high-quality base fabric with small variations in strength and elongation can be obtained, and the amount of fiber wastes derived at the time of weft insertion can be reduced.

(8) A method of manufacturing a base fabric, which uses a jet loom comprising a length measuring device that supplies a weft yarn to a weft yarn supply nozzle for weft-inserting between open warp yarn groups, a contact pressure adjusting member and, on an arrival side fag end of the weft yarn at the time of weft insertion, a pair of weft yarn tension applying members provided opposite to each other across a weft yarn running path, and in a weft yarn catching mechanism for maintaining the weft yarn tension, comprising a first roller which is rotatably supported and rotationally driven by a fixed shaft and a second roller which is rotatably supported by a moving shaft and rotates following the rotation of the first roller by being brought into pressure contact with the first roller, the method comprising a step of adjusting the contact pressure of the second roller with respect to the first roller by the contact pressure adjusting member to adjust the shaking width of the moving shaft in the fixed shaft direction to 5-600 μm and, on the arrival side fag end of the weft yarn at the time of weft insertion, a step of causing a weft yarn running peak tension of 0.4-1.2 cN/dtex to be generated by the weft yarn tension applying member.

According to such a configuration, the jet loom can catch the weft yarn with an appropriate contact pressure by the first roller and the second roller in the length measuring device. Even if the dimension or the like of the first roller is changed, the contact pressure adjusting member maintains the contact pressure of the second roller with respect to the first roller to be constant. As a result, the weft yarn is uniformly supplied to the weft supply nozzle. In addition, the weft yarn at the time of weft insertion can be securely caught, and the appropriate weft yarn tension can be maintained until reed beating is completed. Consequently, a high-quality base fabric with small variations in strength and elongation can be obtained, and the amount of fiber wastes generated during weft insertion can be reduced.

EXAMPLES

Hereinafter, our base fabrics, jet looms and methods will be described more specifically with reference to examples. This disclosure is not limited to the examples. Various physical property values used in the descriptions are in accordance with measuring methods described below.

Measuring Method (1) Total fineness

The total fineness was measured based on corrected mass by the method shown in JIS L 1013 (2010) 8.3.1 B method.

(2) The number of filaments

The number of filaments is calculated based on JIS L 1013 (1999) 8.4 method.

(3) Strength and elongation of yarn

Strength and elongation of yarns were measured under the conditions of constant speed extension shown in JIS L1013 (2010) 8.5.1 standard time test. Sampling was performed by using "TENSILON" UCT-100 manufactured by ORIENTEC Co., LTD at a grip interval of 25 cm and a pulling speed of 30 cm/min. Elongation was obtained from elongation of a point showing the maximum strength in a S-S curve.

(4) Cover factor

A cover factor is a value calculated from a total fineness and a weaving density of yarns used for a warp or weft yarn, and it was defined by equation (1). In equation (1), Dw is a total fineness of a warp yarn (dtex), Df is a total fineness of a weft yarn (dtex), Nw is a weaving density of a warp yarn (2.54 cm/yarn), and Nf is a weaving density of a weft yarn (2.54 cm/yarn):

$$CF=(Dw\times)^{1/2}\times Nw+(Df\times)^{1/2}\times Nf \quad (1).$$

(5) Weaving density of warp/weft yarn (warp yarn density and weft yarn density)

Based on JIS L 1096: (1999) 8.6.1, a sample was placed on a flat table and removed of unnatural wrinkles and tension, and for five different locations in a center in a width direction of a base fabric, the numbers of warp and weft yarns in sections of 2.54 cm were counted to calculate each average value.

(6) Tensile strength

Based on JIS K 6404-3 6. test method B (strip method), for each of a warp direction and a weft direction, five pieces of test specimens were taken from regions divided into five equal parts in a width direction of a base fabric to remove yarns from both sides of the width to form into a width of 30 mm, and the yarns were pulled until the test specimens were cut at a grip interval of 150 mm and a tensile speed of 200 mm/min with a constant-speed tension type testing machine. The maximum load applied until the cutting reached was measured to calculate an average value for each of the warp direction and the weft direction.

(7) Breaking elongation

Based on JIS K 6404-3 6. test method B (strip method), for each of a warp direction and a weft direction, five pieces of a test specimen were taken from regions divided into five equal parts in a width direction of a base fabric to remove yarns were from both sides of the width to form into a width of 30 mm, and gauge lines with intervals of 100 mm were marked at the center of these test specimens, and the yarns were pulled until the test specimens were cut at a grip interval of 150 mm and a tensile speed of 200 mm/min with a constant-speed tension type testing machine. Then, a distance between the gauge lines when the cutting reached was read, and a breaking elongation was calculated by the following equation, to calculate an average value for each of the warp direction and the weft direction:

$$E=[(L-100)/100]\times 100$$

wherein, E is a breaking elongation (%) and L is a distance between gauge lines at the time of cutting (mm).

(8) Air permeability

Five pieces of about 20 cm×20 cm of a test specimen were collected toward a length direction of a base fabric from both ends of a selvage excluding 10 cm from the selvage end of the base fabric to measure them. The larger average value of the average values for the five pieces of the test specimen at both selvages was defined as an air permeability.

(9) Coefficient of variation CV1 in a length direction of a weft-direction disintegrated yarn strength A continuous 20-point measurement of a disintegrated yarn strength of a weft yarn was performed from a center in a width direction to a length direction of a base fabric to calculate a coefficient of variation CV1 from the measured average value and the standard deviation. A strength of the disintegrated yarn was measured based on JIS fiber L1013 8.5.1 "Chemical fiber filament yarn test method."

(10) Coefficient of variation CV2 in a length direction of a weft-direction disintegrated yarn elongation A continuous 20-point measurement of a disintegrated yarn elongation of a weft yarn was performed from a center in a width direction to a length direction of a base fabric to calculate a coefficient of variation CV2 from the measured average value and the standard deviation. An elongation of the disintegrated yarn was measured based on JIS fiber L1013 8.5.1 "Chemical fiber filament yarn test method."

(11) Coefficient of variation in a length of a fringe

A continuous 50-point measurement of a length of a fringe at a selvedge of roll was performed in a length direction of a base fabric using a caliper to calculate a coefficient of variation in the length of the fringe from the measured average value and the standard deviation.

(12) Maximum shaking width of a feed roller

A high speed and high precision CCD laser displacement meter LK-G35 manufactured by KEYENCE CORPORATION was used to measure a maximum shaking width in a vertical direction of a feed roller during operation of a loom.

(13) Weft yarn running peak tension

A P/C compatible tension meter TN-8 manufactured by INTEC Co., Ltd was used to measure a weft yarn running peak tension during operation of a loom.

Example 1

Warp Yarn and Weft Yarn

A synthetic fiber filament was prepared which consists of nylon 66 as warp and weft yarns, is composed of 72 single fiber filaments with a single fiber fineness of 6.53 dtex having a round sectional shape, and has a total fineness of 470 dtex, a strength of 8.5 cN/dtex, and elongation of 23%, with no twist provided.

Warp Yarn Arranging/Beamer Steps

The above-described warp yarn was used to prepare a warp yarn beam with 40 g/unit of a warp yarn arranging sheet tension with a warping machine and with 75 g/unit of a beamer sheet with a beamer.

Weaving Step

A base fabric having 51.2 yarns/2.54 cm of a weaving density of a warp yarn and 51.0 yarns/2.54 cm of a weaving density of a weft yarn was woven using the above-described warp yarn beam and the above-described weft yarn, and using a water jet loom. The warp yarn tension was adjusted to 100 g/yarn, and the loom rotation speed was set to be 730 rpm. A contact pressure adjusting member was used for a length measuring device to suppress vibration of a feed roller of the length measuring device and maintain the state where the feed roller and the length measuring roller were in pressure contact. This contact pressure adjusting member comprises an urging member for adjusting the contact pressure of the feed roller with respect to the length measuring roller and a vibration absorbing member for mitigating vibration generated by the jet loom. Furthermore, a pair of tension applying members was used for an arrival side fag end of the weft yarn so that the weft yarn at the time of weft insertion could be securely caught, and the appropriate weft yarn tension was maintained until reed beating was completed. Moreover, members subjected to uneven processing were adopted for a plate member which protrudes toward the reed side composing this tension applying member. Table 1 shows results of measuring vibration of the feed roller with a laser displacement meter during weaving of the base fabric. Table 1 also shows results of measuring a length of a fringe of the base fabric. In Example 1, the maximum shaking width of the feed roller during weaving was 179 μm, and the weft yarn running peak tension generated by the tension applying member was 1.02 cN/dtex (scouring and heat setting).

Next, the obtained base fabric was scoured at 65° C. and subjected to a heat setting processing for one minute at 120° C. to 180° C. under dimensional regulations of a tentering rate of 0% and an overfeed rate of 0% using a pin tenter dryer.

Coating Step

Next, this woven fabric was coated with a solvent-free silicone resin having a viscosity of 50 Pa·s on the surface by a floating knife coater to be 25 g/m$^2$, followed by vulcanized for one minute at 190° C. to obtain a woven fabric for an airbag.

Example 2

A base fabric was prepared in a similar manner as in Example 1 except that the weaving conditions were changed as shown in Table 1. In Example 2, the coating step was not performed. The results are shown in Table 1. In Example 2, the maximum shaking width of the feed roller during weaving was 200 μm, and the weft yarn running peak tension generated by the tension applying member was 1.15 cN/dtex.

Example 3

A base fabric was in a similar manner as in Example 1 except that the weaving conditions were changed as shown in Table 1. In Example 3, the coating step was not performed. The results are shown in Table 1. In Example 3, the maximum shaking width of the feed roller during weaving was 148 μm, and the weft yarn running peak tension generated by the tension applying member was 0.44 cN/dtex.

Comparative Example 1

A base fabric was prepared in a similar manner as in Example 1 except that, instead of the contact pressure adjusting member, using a tension spring, the feed roller was pressed against the length measuring roller, a mirror-like finishing (polishing) was applied to the plate member which protrudes toward the reed side composing the tension applying member, and the weaving conditions were change as shown in Table 1. The results are shown in Table 1. In Comparative Example 1, the maximum shaking width of the feed roller during weaving was 711 μm, and the weft yarn running peak tension generated by the tension applying member was 1.23 cN/dtex.

Comparative Example 2

A base fabric was prepared in s similar manner as in Comparative Example 1 except that the weaving conditions were changed as shown in Table 1. In Comparative Example 2, the coating step was not performed. The results are shown in Table 1. In Comparative Example 2, the maximum shaking width of the feed roller during weaving was 685 μm, and the weft yarn running peak tension generated by the tension applying member was 1.61 cN/dtex.

Comparative Example 3

A base fabric was prepared in s similar manner as in Example 1 except that a mirror-like finishing (polishing) was applied to the plate member which protrudes toward the reed side composing the tension applying member, and the weaving conditions were change as shown in Table 1. In Comparative Example 3, the maximum shaking width of the feed roller during weaving was 594 μm, and the weft yarn running peak tension generated by the tension applying member was 1.52 cN/dtex.

As shown in Table 1, any of the base fabrics of Examples 1 to 3, in which the coefficient of variation CV1 in the length direction of the weft-direction disintegrated yarn strength is 3.0% or less and the coefficient of variation CV2 in the length direction of the weft-direction disintegrated yarn elongation is 4.0 or less, are high-quality base fabrics with small variations in strength and elongation, and it was considered that the amount of fiber wastes generated during manufacturing could be reduced since the shaking width of the feed roller could be suppressed to be smaller and the weft yarn running peak tension by the weft yarn tension applying member could be suppressed to be smaller. On the other hand, any of the base fabrics of Comparative Examples 1 to 3, in which at least the coefficient of variation CV1 in the length direction of the weft-direction disintegrated yarn strength exceeded 3.0% or the coefficient of variation CV2 in the length direction of the weft-direction disintegrated yarn elongation exceeded 4.0%, have large variations in strength and elongation, and it was considered that the amount of fiber wastes generated during manufacturing could not be sufficiently reduced since the shaking width of the feed roller became increased and the weft yarn running peak tension by the weft yarn tension applying member became increased.

TABLE 1

| Measurement Item | Unit | Example 1 | Example 2 | Example 3 | Comparative Example 1 | Comparative Example 2 | Comparative Example 3 |
|---|---|---|---|---|---|---|---|
| Loom rotation speed | rpm | 730 | 700 | 500 | 700 | 500 | 700 |
| Width for passing through reed | mm | 2234 | 2180 | 1800 | 2234 | 18 | 2234 |
| Total fineness of ground yarn | dtex | 470 | 470 | 22 | 470 | 22 | 470 |
| Number of filaments | — | 72 | 136 | 20 | 72 | 20 | 72 |
| Structure | — | Flat | Flat | Flat | Flat | Flat | Flat |
| Weaving density (warp) | yarn/ 2.54 cm | 51.2 | 55.0 | 205 | 51.1 | 205 | 51.2 |
| Weaving density (weft) | yarn/ 2.54 cm | 51.0 | 55.0 | 158 | 50.8 | 158 | 51.0 |
| Cover factor | — | 2216 | 2385 | 1703 | 2209 | 1703 | 2216 |
| Thickness | mm | 0.33 | 0.33 | 0.08 | 0.32 | 0.08 | 0.33 |
| Basis weight | $g/m^2$ | 228 | 221 | 55 | 225 | 55 | 227 |
| Coating amount | $g/m^2$ | 25 | — | — | 25 | — | 25 |
| Tensile strength (warp) | N | 3792 | 3803.5 | — | 3784 | — | 3788 |
| Tensile strength (weft) | N | 3727 | 3799 | — | 3715 | — | 3730 |
| Breaking elongation (warp) | % | 33.8 | 35.5 | — | 33.6 | — | 32.8 |
| Breaking elongation (weft) | % | 32.3 | 25.5 | — | 32.4 | — | 31.7 |
| Coefficient of variation CV1 in length direction of weft-direction disintegrated yarn strength | % | 0.97 | 0.87 | 1.4 | 3.19 | 3.5 | 3.02 |
| Coefficient of variation CV2 in length direction of weft-direction disintegrated yarn elongation | % | 2.8 | 2.57 | 3.3 | 4.46 | 4.23 | 3.61 |
| Selvedge of roll Coefficient of variation CV1' in length direction of weft-direction disintegrated yarn strength | % | 1.66 | 1.52 | 1.7 | 3.36 | 3.27 | 3.05 |
| Selvedge of roll Coefficient of variation CV2' in length direction of weft-direction disintegrated yarn elongation | % | 2.39 | 2.2 | 2.4 | 4.42 | 4.37 | 3.82 |
| Length direction coefficient of variation CV3 of fringe | % | 3.01 | 3.68 | 2.52 | 9.98 | 8.29 | 7.93 |
| Maximum shaking width of feed roller | μm | 179 | 200 | 148 | 711 | 685 | 594 |
| weft yarn running peak tension by weft yarn tension applying member | cN/ dtex | 1.02 | 1.15 | 0.44 | 1.25 | 1.61 | 1.52 |

The invention claimed is:

1. A base fabric having a coefficient of variation CV1 (100×standard deviation/average value) of 3.0% or less in a length direction of a weft-direction disintegrated yarn strength, and a coefficient of variation CV2 (100×standard deviation/average value) of 4.0 or less in a length direction of a weft-direction disintegrated yarn elongation wherein the coefficient of variation is calculated by a continuous 20-point measurement of the disintegrated yarn strength from a center in a width direction to a length direction of the base fabric and then from the measured average value and the standard deviation.

2. A base fabric comprising:

a fabric part, and selvages having a predetermined width formed at both ends in a length direction of the fabric part, respectively, and having a coefficient of variation CV1' (100×standard deviation/average value) of 3.0% or less in a length direction of a weft-direction disintegrated yarn strength in a width direction including the selvages, and a coefficient of variation CV2' (100×standard deviation average value) of 4.0 or less in a length direction of a weft-direction disintegrated yarn elongation in a width direction including the selvages wherein the coefficient of variation is calculated by a continuous 20-point measurement of the disintegrated yarn strength from a center in a width direction to a length direction of the base fabric and then from the measured average value and the standard deviation.

3. A base fabric consisting of a synthetic fiber, and including a fabric part, and selvages having a predetermined width formed at both ends in the length direction of the fabric part, respectively, wherein the selvage has a fringe protruded from a weft yarn and has a length direction coefficient of variation CV3 (100×standard deviation/average value) of 8.0% or less of the fringe in a length direction of the base fabric wherein the coefficient of variation is calculated by a continuous 20-point measurement of the disintegrated yarn strength from a center in a width direction to a length direction of the base fabric and then from the measured average value and the standard deviation.

4. An airbag comprising the base fabric of claim 1.

5. An airbag comprising the base fabric of claim 2.

6. An airbag comprising the base fabric of claim 3.

* * * * *